United States Patent [19]

Blair et al.

[11] 4,389,245

[45] Jun. 21, 1983

[54] LANCE LADLING

[75] Inventors: Matthew J. Blair, Niles; Thomas A. Wiktorowski, Parma Heights; W. Dale Wogan, Warren, all of Ohio

[73] Assignee: Republic Steel Corporation, Cleveland, Ohio

[21] Appl. No.: 311,175

[22] Filed: Oct. 14, 1981

Related U.S. Application Data

[63] Continuation of Ser. No. 165,709, Jul. 3, 1980.

[51] Int. Cl.[3] ..... C21C 7/02

[52] U.S. Cl. ..... 75/58; 75/53

[58] Field of Search ..... 75/53, 58

[56] References Cited

U.S. PATENT DOCUMENTS 4,211,553 7/1980 Honkaniemi ..... 75/53

*Primary Examiner*—P. D. Rosenberg

*Attorney, Agent, or Firm*—Watts, Hoffmann, Fisher & Heinke

[57] ABSTRACT

A method and apparatus for concurrent introduction of molten steel and gas-fluidized chemical steel additives, such as chemical desulphurants, into a teeming ladle 10. Injection apparatus includes a lance 52 arranged to remain with the vessel. Introduction of gas-fluidized additives through a lance opening 81 is commenced while a charge of molten steel is introduced into the ladle. The lance is unobstructed at its discharge end and in one embodiment is carried directly by a discharge stopper 31".

16 Claims, 4 Drawing Figures

LANCE LADLING

This is a continuation of application Ser. No. 165,709 filed July 3, 1980.

DESCRIPTION

1. Technical Field

This invention relates to methods and apparatus for making additions of chemicals, such as chemical desulphurants, to molten steel, particularly through a lance during the transfer of molten steel from one container to another.

2. Background Art

Additions of chemicals to molten steel are commonly used, for example, to give finished steel desirable physical properties, desulphurize molten steel, and deoxidize and degas molten steel prior to casting. Depending upon the intended finished steel product, the nature of the chemical additives and the convenience of a particular method of addition, chemical additions have been made at a variety of points in the steel making process using various methods. Chemicals have been added to molten steel in furnaces and injected into molten steel, both within a transfer vessel, and during the physical transfer of molten steel from one vessel containing the molten steel to another.

One difficulty with placing additives directly into the steel making furnace before tapping is an uneven distribution of the chemicals within the batch of steel, resulting in difficulties with finished steel quality. Also, that approach gives the completed steel batch unique finished properties, yet the entire contents of a furnace may be more than demand requires.

To treat smaller quantities of steel, additions of chemicals are made during the tapping of steel from a furnace. Typically, a stream of particulate additives is introduced into a flow of steel being tapped from a furnace and the particulate passes with the steel through a mechanically agitated zone where the steel and additives are blended, after which any slag and residual chemicals are separated from the treated steel. Mechanical agitation used to blend the steel and additives has often proved troublesome, and the requirement of a residence time for the steel and additives together at the mixer to achieve proper distribution of the additive in the steel restricts the speed with which a furnace can be tapped. Once the steel has passed from the furnace through the mixer, further additive additions are difficult to make.

Placement of additives in the bottom of a transfer vessel prior to tapping or pouring a charge of steel into the vessel is another known approach to making chemical additions. Difficulty in achieving satisfactory mixing of the chemicals with the steel within the transfer vessel, has restricted use of this method.

Another process for making chemical additions to steel is lance-injection of gas-fluidized additives into molten steel contained within a vessel. In this process a particulate gas fluidizer at a treating station supplies additives with a flow of gas through a heat resistant lance. The lance is carried by an insertion apparatus associated with the treating station that places the lance into sucessive molten steel vessels for treatment. Following introduction of a charge of additives, the lance is withdrawn by the carrier and the vessel is relocated for further steel processing. Difficulties have arisen when the lance has become damaged, for example by heat from the molten steel, to an extent requiring replacement thereby shutting down the treating station. Since steel cannot be treated while the treating station is out of service, steel production is slowed, or stopped. In addition, should chemical additions subsequent to an initial treatment be required, it is necessary to return the vessel to the treating station. Since the lance carrier used to lower the lance into the vessel is generally complex, the economic feasibility of constructing multiple treating stations is not favorable unless each station is used regularly, thus precluding standby treatment stations in many applications. Because of violent steel splashing induced by high rates of chemical introduction into the steel, high introduction rates into full, open top, steel vessels have not been feasible.

Additives have also been charged into a flow of steel entering a mold or casting device. Generally the additives have been particulates introduced into the flow of steel and used for degassing the steel. Turbulence within the mold has been relied upon to mix the additives and the steel.

Additives for steel being tapped or poured from one vessel to another have been introduced through a chute terminating adjacent to the stream of flowing metal. A carrier or station is usually required to support the chute adjacent the flowing metal, and an updraft induced in the chute by proximity to the hot flowing metal often carries additive dust up the chute where the heat and dust can cause difficulties for both a human operator and sensitive control equipment positioned near the upper end of the chute.

The known systems for making chemical additives present shortcomings or disadvantages that make an improved process and apparatus for injecting particulate additives desirable.

DISCLOSURE OF THE INVENTION

The present invention provides an apparatus and method for the introduction of chemical additives into steel through a lance in a manner that reduces or eliminates many of the prior art difficulties associated with chemical additives.

By the present invention, individual vessels and associated structures for receiving and containing molten steel are provided with individual injection lances supported by each vessel or the associated structure. The lance for each vessel includes a conduit shielded from the heat of the molten steel by a refractory material. One end of the lance is above the vessel and arranged to communicate with a source of gas and gas fluidized chemical additives being introduced into the steel. The other end is located near the bottom of the vessel and provides one or more unobstructed openings through which the chemical additives are introduced subsurface to the molten steel.

Advantages from the invention are achieved by introducing particulate chemical steel additives entrained in a gas flow into the molten steel vessel during the transfer of molten steel into the vessel, the entrained additives being introduced subsurface to metal present in the vessel through the lance. The gas and particulate flow into the steel is continued until a predetermined quantity of additives have been introduced. While additives have been introduced subsurface to steel in other applications, additive injection in accordance with the present invention during introduction of steel into the vessel and through individual lances carried with each vessel provides exceptional advantages.

In a preferred embodiment, gas and additives are introduced at relatively high flow rates and pressures early during the transfer of steel into the vessel, while the vessel is relatively unfilled and free board in the vessel is relatively large. Thus, notwithstanding splashing and turbulence of the metal, induced by the gas and additives delivered at the relatively high additive flow rates and gas pressures there is little or no loss or escape of metal from the vessel. As steel continues to be transferred into the vessel and free board decreases, the flow rate and pressure of the gas and additives introduced into the molten steel are reduced, thereby suppressing molten steel splashing and turbulence. The relatively high flow rate and pressure of the gas and entrained additives early during transfer of the molten steel and the associated turbulence, results in uniform distribution of the chemical additives within the steel. When, e.g., chemical steel desulphurants are introduced utilizing this invention, the improved distribution produces an unexpectedly low sulphur level of less than 50 parts per million in the desulphurized steel.

Advantageously, the introduction of fluidized additives subsurface to the steel is begun when the transfer of molten steel into the vessel is between one-fifth to one-half complete, and is continued during the completion of the molten steel transfer. Alternatively, a flow of entraining gas can be initiated through the lance prior to or concurrently with the introduction of molten steel, and prior to the introduction of entrained additives. If desired, gas alone or gas-entrained additives can be continued after completion of the steel transfer to the vessel.

In a preferred embodiment, the lance is supported from a structure attached to the molten-steel-containing vessel, advantageously to a trunnion structure when the vessel is a ladle. The lance, as supported, terminates in an unobstructed opening adjacent to the vessel bottom, and is thereby positioned at all times to facilitate lance introduction of additives into the ladle. This avoids, e.g., the necessity for transporting the ladle to a station where a lance associated with the station is then inserted into the ladle. Rather, it is only necessary to connect an inlet of the prepositioned lance to a source of entrained additives.

In an alternative embodiment, the lance and a stopper for sealing a bottom vessel outlet are interconnected and jointly supported from the vessel. The lance opening is thereby positioned closely adjacent to the vessel bottom outlet without need for a separate support structure. In addition to the lance functioning as described, it can be used to introduce additives into molten steel being discharged from the vessel bottom outlet.

A variety of chemical additives may be introduced into molten steel using this invention. It is preferred that the additives be of a particulate nature. Generally the additives are entrained in a gas stream using any of a number of well known apparatus for particulate fluidization. In preferred embodiments, the lance is connected to the discharge of such a fluidizing apparatus and the fluidizer output, controlled as to pressure and flow rate, is introduced through the lance subsurface to the steel as the steel is transferred into the vessel. The chemical additive frequently contains a desulphurization material, often including calcium carbonate ($CaCO_3$) or other substance which evolves gasses upon exposure to the hot molten steel. Gas evolution enhances the turbulence generated by subsurface introduction of gas entrained materials, and thereby enhances distribution of the additives in the molten steel.

In accordance with the present invention, fluidized desulphurants are introduced to the vessel at between 1 and 25 psi in excess of a static pressure (ferrostatic pressure) exerted by the liquid level of molten steel above the lance opening. Since pressure and flow rate of a gas-fluidized substance vary in a direct relationship, control of a differential between the pressure of the fluidized material available at the fluidizer and the ferrostatic pressure is utilized to establish the flow rate of gas and gas-fluidized additive introduced subsurface to the steel. In this manner the degree of agitation and splashing within the vessel is also controlled.

In the preferred practice, flow rate of fluidizing gas is additionally controlled to maintain a ratio of fluidizing gas to fluidized particulate additive of less than 0.15 cubic feet per pound. Higher gas-to-solid ratios are feasible, but generally are unnecessary to achieve the desired distribution of additives within the molten steel contained in the vessel.

An important feature of this invention is that a station for chemical introductions into molten steel by injection lance need not include the lance and a support therefore. In the prior devices, on such stations that included both a lance and support, where a lance failure occurred, no steel could be treated until the lance was repaired or replaced. With this invention, a lance failure disables treatment only of the steel in the particular vessel suffering the failure. It is contemplated that the lances of this invention will be regularly consumed and replaced during the steel making process.

The above and other features of the invention will become more apparent from the detailed description that follows, when considered in connection with the accompanying drawings.

BEST MODE FOR CARRYING OUT THE INVENTION

Figure 1:
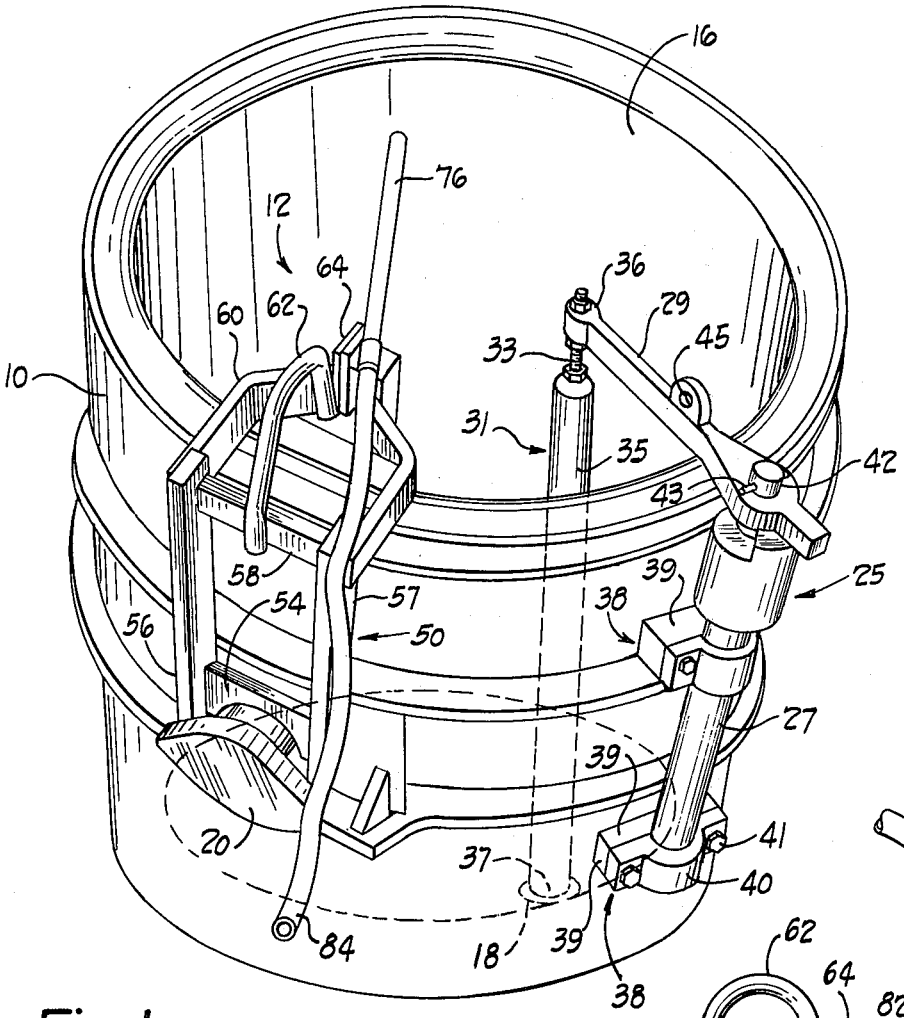
FIG. 1 is a perspective view of a steel transfer vessel or teeming ladle embodying the fluidized additive injection lance of this invention shown positioned for injection use.
Figure 2:
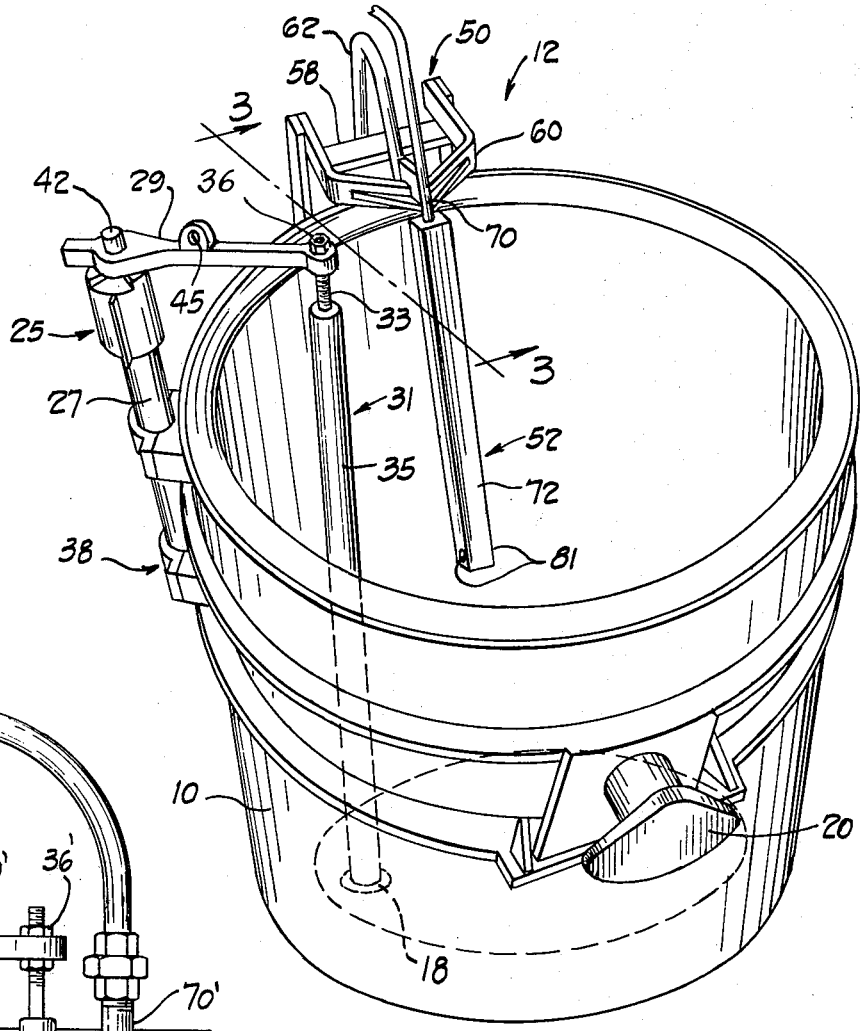
FIG. 2 is a perspective view of the ladle shown in FIG. 1 viewed from a different position.

Referring to the drawings, a molten steel transportation vessel or ladle 10 is shown in FIGS. 1 and 2 including a lance assembly 12 of the invention.

The vessel 10 is of any suitable or conventional construction well known in the steel making industry. The vessel has a protective lining 16, such as refractory brick or the like. An outlet 18 for discharging molten steel from the bottom of the vessel is also protectively lined. Trunnions 20 on opposite sides of the vessel facilitates lifting and transporting. A stopper apparatus 25 closes the bottom outlet 18 and can be lifted to discharge the vessel contents. The stopper apparatus 25 includes a cylindrical support and guide 27, a stopper support arm 29, and a rod-like stopper 31.

The stopper 31 includes a central core 33 and a protective jacketing 35 of refractory brick or the like. The core 33 is attached to the support arm 29 by a nut 36. The stopper 31 terminates in a tapered lower end 37 shaped to be received in and prevent molten steel from flowing through the bottom outlet 18.

Two mounts 38 attach the cylindrical support 27 to the vessel 10. The mounts each include a pad 39 attached to the vessel and a clamp 40. The cylindrical support is received between the pad 39 and clamp 40 and held in position by bolts 41 that join the pad 39 and clamp 40.

A shaft portion 42 of the stopper assembly 25 is slidably received in the cylindrical support 27. The support arm 29 is carried by the shaft 42. A pin 43 retains the support arm on the shaft.

The support arm 29 includes an eye 45. By connection of a lifting device such as a hoist or the like (not shown) to the eye 45, the support arm may be raised or lowered thereby, raising the stopper 31 from the bottom outlet 18 to permit discharge of molten steel, or lowering the stopper to stop the flow. Sliding movement of the shaft 42 in the cylindrical support 27 assists in guiding the stopper into the bottom outlet.

The lance assembly 12 (FIGS. 1, 2 and 3) is comprised of a mounting assembly 50 and a lance 52. The mounting assembly 50 positions and supports the lance 52 within the vessel 10.

The mounting assembly includes a lower bridge 54 partially surrounding the trunnion 20, a pair of vertical runners 56, 57, an upper cross brace 58, and a platform 60. The brace 58 and the bridge 54 connect the runners 56, 57 which attach to the platform. A U-brace 62 is attached between the brace 58 and the runners and is used for lifting the assembly 12 from the vessel 10. A vertical attachment plate 64 for the lance is affixed to the platform at a location over the inside of the vessel.

Figure 3:
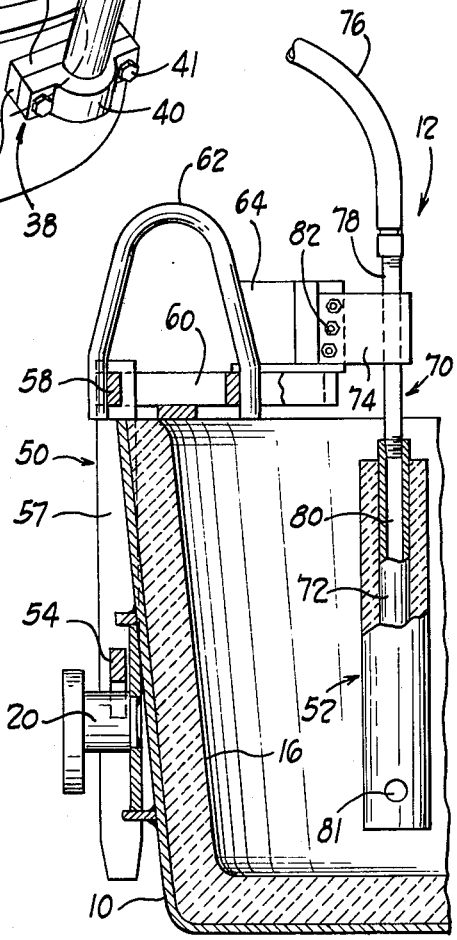
FIG. 3 is a partial sectional view taken along the plane indicated by the line 3—3 of FIG. 2 showing the lance and supporting structure.

The lance 52, as best illustrated in FIG. 3, includes a conduit 70, a protective jacket 72 and a connector plate 74. The conduit includes an inlet conduit portion 76 also called a connecting portion, a transition portion 78, and a portion 80 encased in the protective jacket 72 and having an unobstructed opening 81 at the lance end. As may be seen in FIG. 3, the opening is positioned near the vessel bottom. The transition piece 78 is attached to the connector plate 74. Fasteners 82 attach the connector plate 74 to the attachment plate 64 so the lance 52 is supported vertically within the vessel, with the lower end somewhat above the bottom of the vessel.

In accordance with this invention, treatment of molten steel with gas-fluidized chemical additives is accomplished while the steel is being poured or tapped into the vessel 10. A hose 82 is connected between a fluidizer (not shown) of any conventional or suitable construction and the inlet conduit portion 76 of the lance conduit 70. The desired chemical additives are fluidized utilizing the fluidizer in a procedure well known in the industry, and while the transfer of molten steel into the vessel is less than half complete, addition of a predetermined quantity of the fluidized additives is begun through the lance. The additives are initially introduced rapidly, producing violent splashing of the molten steel. With the vessel only half filled, substantial vessel freeboard exists that accommodates the splashing, retaining the molten steel within the vessel. As the molten steel transfer nears completion and vessel freeboard is reduced, the rate at which additive is supplied is slowed to reduce the violent splashing of steel to within limits that assure containment within the vessel.

As the molten steel fills the vessel, pressure from the liquid level of molten steel in the vessel or ferrostatic pressure at the conduit opening 81 increases. Flow rate of the fluidized additives into the vessel is dependent partly upon the difference in pressure between the fluidizer and the conduit opening 81. Depending upon the desired rate at which additive is to be supplied, the pressure of the additive stream leaving the fluidizer is maintained at between 1 and 25 pounds per square inch in excess of the ferrostatic pressure. As the ferrostatic pressure at the opening 81 rises with an increasing molten steel level within the vessel, the pressure of the stream of fluidized additives supplied at the fluidizer must be adjusted upwardly if the flow rate of additives is to be maintained at a given value. Since it will normally be desirable to reduce the flow rate of additives to control molten steel splashing as the transfer nears completion, upward adjustments to fluidizer delivery pressure will normally be less than increases in the ferrostatic pressure.

From time to time it is desirable to provide a flow of gas through the lance prior to beginning a steel transfer or during the steel transfer and prior to introduction of the additives. Also, where addition of the predetermined charge of additives has not been completed prior to termination of the steel transfer, addition can be continued until the additive charge is completed. Following completion of addition of the predetermined additive charge, and where it is desirable to cool the molten steel and promote further mixing of the additives in the steel, gas alone may be introduced into the molten steel through the lance. A particular advantage of the vessel mounted lance of this invention is that the gas introduced after completion of the additive charge may be supplied either from the fluidizer or from some other source of gas. Should some other gas source be utilized, the fluidizer is then available for treatment of metal in a subsequent vessel.

The following example will serve to illustrate further the advantages of the invention. A stream of molten steel, superheated by approximately 50° F., is tapped into a vessel or teeming ladle 10 furnished with the lance assembly 12 of this invention as described above. A charge of a desulphurant chemical additive comprising between 50% and 100% Calcium oxide (CaO) and between 0 and 50% Calcium di-floride ($CaF_2$) is determined, sufficient to desulphurize the steel being transferred, based upon well known calculations founded upon an analysis of the sulphur present in the molten steel. This chemical desulphurant is blended both with any of a number of well known materials that will develop a slag covering over the molten steel within the ladle, and with aluminum. Before the steel transfer is one-half completed, this blended desulphurant is fluidized in an argon gas stream and injected through the lance subsurface to the steel in the ladle. Initial injection rates are 250 to 300 pounds of the blended desulphurant per minute. Flow of the argon gas is controlled to be in a ratio of 0.005 to 0.15 cubic feet of argon per pound of blended desulfurant as measured when discharged from the fluidizer.

In the example, injection of the desulfurant precipitates violent splashing of the molten steel within the vessel, thoroughly mixing the desulphurant and the molten steel. As the vessel fills with steel, the rate of introduction of the blended desulphurant is gradually reduced until an addition rate of approximately 100 pounds of blended desulphurant per minute is reached. The ratio of gas to blended desulphurant is maintained in the range of 0.005 to 0.15 cubic feet per pound. When the predetermined desulphurant charge has been introduced, addition of fluidized desulphurant is stopped. Fluidizing gas is then introduced as desired to remove any remaining superheat. By virtue of the excellent mixing associated with the extreme splashing and agitation caused by the initial elevated rates of desulphurant addition, the sulphur levels in the steel following introduction of the blended desulphurant charge is less than 0.005% or 50 parts per million.

Figure 4:
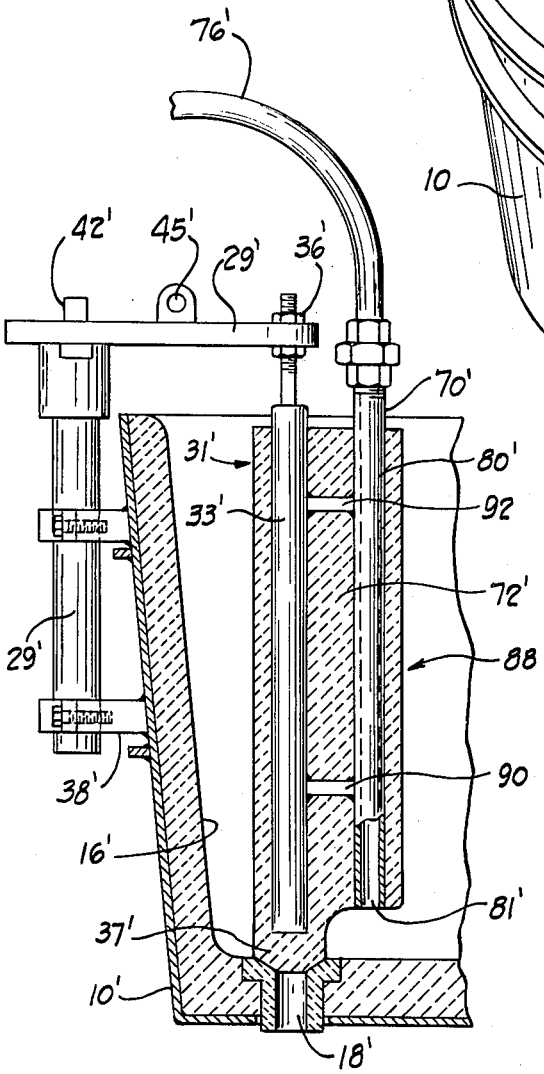
FIG. 4 is a partial sectional view, similar to that of FIG. 3, showing an alternative embodiment of a lance of this invention.

In an alternative embodiment, as illustrated in FIG. 4, a lance 88 is supported within the vessel by attachment to a stopper 31'. In this embodiment, parts similar to those in the embodiment of FIGS. 1–3 are identified with like reference numbers, primed. As in the previous embodiment, the stopper includes a core 33' and is supported by an arm 29'. The lance 88 includes a conduit 70' having a connecting portion 76' and an encapsulated portion 80' that terminates in an unobstructed opening 81' above and near a bottom outlet 18' of the vessel. The encapsulated portion 80' is supported from the core 33' by braces 90, 92. A protective jacketing material 72' such as refractory brick or the like, encapsulates the core 33', the braces 90, 92 and the conduit portion 80' to protect these parts from heat of the molten steel.

A tapered end portion of the stopper 31' is seated in the opening 18' to prevent molten steel from flow from the vessel. The stopper 31' may be lifted from the bottom outlet 18' to allow molten steel to flow from the vessel. The opening 81' is positioned to introduce additives into the molten steel as it exits from the vessel through the outlet 18' if desired. In supporting the lance conduit portion 80' from the stopper core 33', the lance mounting apparatus 50 is eliminated.

While a preferred embodiment of the invention has been described in detail, it will be apparent that various modifications or alterations may be made therein without departing from the spirit and scope of the invention as set forth in the appended claims.

We claim:

1. In a process of injecting ladle additives into molten steel, the steps comprising:

transferring molten steel into a vessel;

entraining a particulate additive in a gas flow;

supporting on the vessel a refractory-protected conduit of constant length having an unobstructed opening positioned at a fixed location within the vessel, introducing the gas flow and additive below the surface of the steel at a constant level within the vessel through said conduit while the molten steel is being transferred into the vessel; and continuing the introduction of gas flow and additive into the vessel at said level until a predetermined quantity of additives has been introduced.

2. In a process of injecting ladle additives into the molten steel, the steps comprising:

transferring molten steel into a vessel;

entraining a particulate additive in a gas flow;

introducing a gas flow and additive below the surface of the steel within the vessel initially at a relatively high pressure and flow rate while the molten steel is being transferred to create turbulence within the molten steel; and continuing the introduction of gas flow and additives into the vessel at a reduced pressure and flow rate as the level of steel in the vessel increases, until a predetermined quantity of additives has been introduced.

3. Apparatus for desulphurizing molten steel including: a vessel having a bottom outlet; a bottom outlet stopper rod that seals the outlet against molten steel egress; and a lance continuously supported from the stopper rod and retained in the vessel and terminating therein, for the subsurface injection of fluidized desulphurization compounds into the molten steel received in the vessel, the lance including a conduit surrounded by refractory material, the conduit communicating at one end with a source of gas and gas fluidized chemical steel additives, and the conduit terminating in at least one unobstructed opening adjacent and above the vessel bottom.

4. Apparatus for desulphurizing molten steel including: a vessel; and a lance continuously supported by and retained in the vessel and terminating therein, for the subsurface injection of fluidized desulphurization compounds into the molten steel received in the vessel, the lance including a conduit surrounded by a refractory material, the conduit communicating at one end with a source of gas and gas fluidized chemical steel additives, and terminating in at least one unobstructed opening adjacent and above the vessel bottom; and means secured to the lance, extending across a portion of a wall of the vessel to support the lance in the vessel.

5. The process as set forth in claim 1 including the steps of initially introducing the gas flow and additive at a relatively high pressure and flow rate to create turbulence within the molten steel and subsequently introducing them at a reduced pressure and flow rate as the level of steel in the vessel increases.

6. In the process of either of claims 1 or 2, the step of continuing to introduce a gas flow into the vessel after the transfer is completed.

7. In the process of either of claims 1 or 2, the step of continuing to introduce both gas flow and additive into the vessel after the transfer is completed.

8. A ladle injector and stopper assembly for use in injecting chemical additives into ladles containing molten steel, and preventing molten steel egress from a ladle bottom outlet comprising:

a ladle stopper including a terminal portion for seating on a ladle stopper seat thereby preventing molten steel egress from the ladle bottom outlet;

means connected to the stopper to facilitate raising and lowering the stopper relative to the ladle stopper seat; and an injection lance alongside and connected to the stopper including:

(i) a central conduit including refractory material surrounding the conduit, (ii) a conduit outlet portion, located adjacent and above the ladle stopper seat, from which additives are ejected into molten steel contained within the ladle, and (iii) an inlet portion, the injection lance communicating thereby with a source of gas fluidized additives.

9. The assembly of claim 8 wherein the conduit is a pipe, and the refractory material surrounding the pipe is a refractory sleeve.

10. The assembly of claim 8 wherein refractory material surrounds both the conduit and the stopper.

11. A method for the desulphurization of molten steel including the steps of:

providing a vessel and an injection lance supported by the vessel, the lance terminating in an unobstructed opening at a fixed location within and near the bottom of the vessel;

connecting a source of gas and fluidized particulate desulphurization material to the lance;

introducing molten steel into the vessel;

retaining the molten steel within the vessel;

fluidizing a particulate desulphurization material in a flow of a gas;

injecting the fluidized particulate in a stream through the unobstructed lance opening at a constant level within the vessel subsurface to the steel and near the vessel bottom, while the steel is being introduced, at a ratio of gas to particulate of not more than 0.15 cubic feet per pound; and continuing to inject gas and particulate as the vessel fills and until the injection of a desired quantity of desulphurization particulate is complete.

12. The method of claim 11 including the step of introducing gas and fluidized particulate subsurface to the steel at a pressure of from 1 to 25 psi in excess of the pressure exerted by the static depth of molten steel above the lance opening.

13. The method of claim 11 including the step of introducing the gas through the unobstructed opening prior to commencing charging of fluidized desulfurant.

14. The method of claim 11 including the step of continuing to introduce the gas through the unobstructed opening subsequent to completion of the charge of fluidized desulfurant.

15. The method as set forth in claim 11 including the steps of initially introducing the gas flow and additive at a relatively high pressure and flow rate to create turbulence within the molten steel and subsequently introducing them at a reduced pressure and flow rate as the level of steel in the vessel increases.

16. Apparatus as set forth in claim 4, wherein the vessel has support trunnions and the said means secured to the lance to support the lance in the vessel engages a trunnion of the vessel.

* * * * *